US009061407B2

(12) United States Patent
Chien et al.

(10) Patent No.: US 9,061,407 B2
(45) Date of Patent: Jun. 23, 2015

(54) CONTROL MECHANISM FOR ELECTRIC NAIL GUN

(75) Inventors: Chia-Yu Chien, Taichung (TW); Chien-Kuo Po, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 712 days.

(21) Appl. No.: 13/286,940

(22) Filed: Nov. 1, 2011

(65) Prior Publication Data

US 2012/0104069 A1 May 3, 2012

(30) Foreign Application Priority Data

Nov. 3, 2010 (TW) ..... 99221280 U

(51) Int. Cl.

| | |
|---|---|
| ***B21J 15/28*** | (2006.01) |
| ***B27F 7/17*** | (2006.01) |
| ***B25C 1/00*** | (2006.01) |
| ***B25C 1/06*** | (2006.01) |

(52) U.S. Cl.
CPC .. *B25C 1/008* (2013.01); *B25C 1/06* (2013.01)

(58) Field of Classification Search
CPC ..... B25C 1/008; B25C 1/06; B25C 1/043
USPC ..... 227/1–7, 117, 133, 147; 173/90, 213
See application file for complete search history.

(56) References Cited

U.S. PATENT DOCUMENTS

| | | | | |
|---|---|---|---|---|
| 6,357,647 | B1 * | 3/2002 | Ou | 227/8 |
| 8,336,749 | B2 * | 12/2012 | Largo | 227/10 |
| 2012/0104070 | A1 * | 5/2012 | Wu et al. | 227/8 |
| 2014/0110450 | A1 * | 4/2014 | Moore et al. | 227/2 |
| 2014/0110452 | A1 * | 4/2014 | Moore et al. | 227/8 |

* cited by examiner

*Primary Examiner* — Robert Long
(74) *Attorney, Agent, or Firm* — Marger Johnson & McCollom PC

(57) ABSTRACT

The control mechanism for an electric nail gun includes: a first sensor for generating a first sensing signal in response to movement of a safety member of the electric nail gun; a second sensor for generating a second sensing signal in response to operation of a trigger member of the electric nail gun; an actuating piece adjusted selectively between a single shot position and a successive shooting position, and rotatable relative to the trigger member; a third sensor for generating a third sensing signal in response to rotation of the actuating piece; and a control unit activating a driving module of the electric nail gun upon receipt of either one of the first and second sensing signals from the first and second sensors, and energizing an electromagnetic valve of the electric nail gun upon receipt of the third sensing signal from the third sensor.

8 Claims, 10 Drawing Sheets

CONTROL MECHANISM FOR ELECTRIC NAIL GUN

CROSS-REFERENCE TO RELATED APPLICATION

This application claims priority to Taiwanese Application No. 099221280, filed on Nov. 3, 2010.

BACKGROUND OF THE INVENTION

1. Field of the Invention

The invention relates to an electric nail gun, and more particularly to a control mechanism for an electric nail gun.

2. Description of the Related Art

A conventional electric nail gun includes: a safety member for pushing against a workpiece; a safety switch triggered in response to motion of the safety member; a trigger switch triggered in response to pressing of a trigger member; a selector switch operable to switch between a single shot mode and a successive shooting mode of operation of the electric nail gun; and a control unit connected electrically to the safety switch, the trigger switch and the selector switch.

The control unit is capable of driving the electric nail gun to operate in one of the single shot mode and the successive shooting mode based on a switch signal from the selector switch. In the single shot mode, the safety switch and the trigger switch are triggered in order. In the successive shooting mode, the safety switch and the trigger switch are triggered simultaneously, and the trigger member is pressed continuously while the safety member is retained to push against a targeted workpiece.

However, in order to adjust the selector switch, an additional circuit connected between the selector switch and the control unit is required. Such a circuit is relatively complicated and expensive, and may easily incur interference from the external environment.

SUMMARY OF THE INVENTION

Therefore, an object of the present invention is to provide a control mechanism for an electric nail gun that has a relatively simple structure and that can ensure a stable operation of the electric nail gun between a single shot mode and a successive shooting mode.

According to the present invention, there is provided a control mechanism for an electric nail gun. The electric nail gun includes a safety member movable between a normal position and a pushed position, a pivotally movable trigger member, an impact unit for nail-striking, a driving module for driving movement of the impact unit to perform a nail-striking operation, and an electromagnetic valve for driving the impact unit to move toward the driving module such that the impact unit is driven by the driving module to perform the nail-striking operation. The control mechanism comprises:

a first sensor adapted to be disposed adjacent to the safety member and operable to generate a first sensing signal in response to movement of the safety member from the normal position to the pushed position;

a second sensor operable to generate a second sensing signal in response to operation of the trigger member;

an actuating piece adapted to be mounted movably in the trigger member such that the actuating piece is adjusted selectively to one of a single shot position and a successive shooting position, and rotatable relative to the trigger member when in any one of the single shot position and the successive shooting position;

a third sensor operable to generate a third sensing signal in response to rotation of the actuating piece; and a control unit adapted to be connected electrically to the driving module and the electromagnetic valve, and connected electrically to the first, second and third sensors.

The control unit activates the driving module upon receipt of either one of the first and second sensing signals from the first and second sensors, and energizes the electromagnetic valve upon receipt of the third sensing signal from the third sensor.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
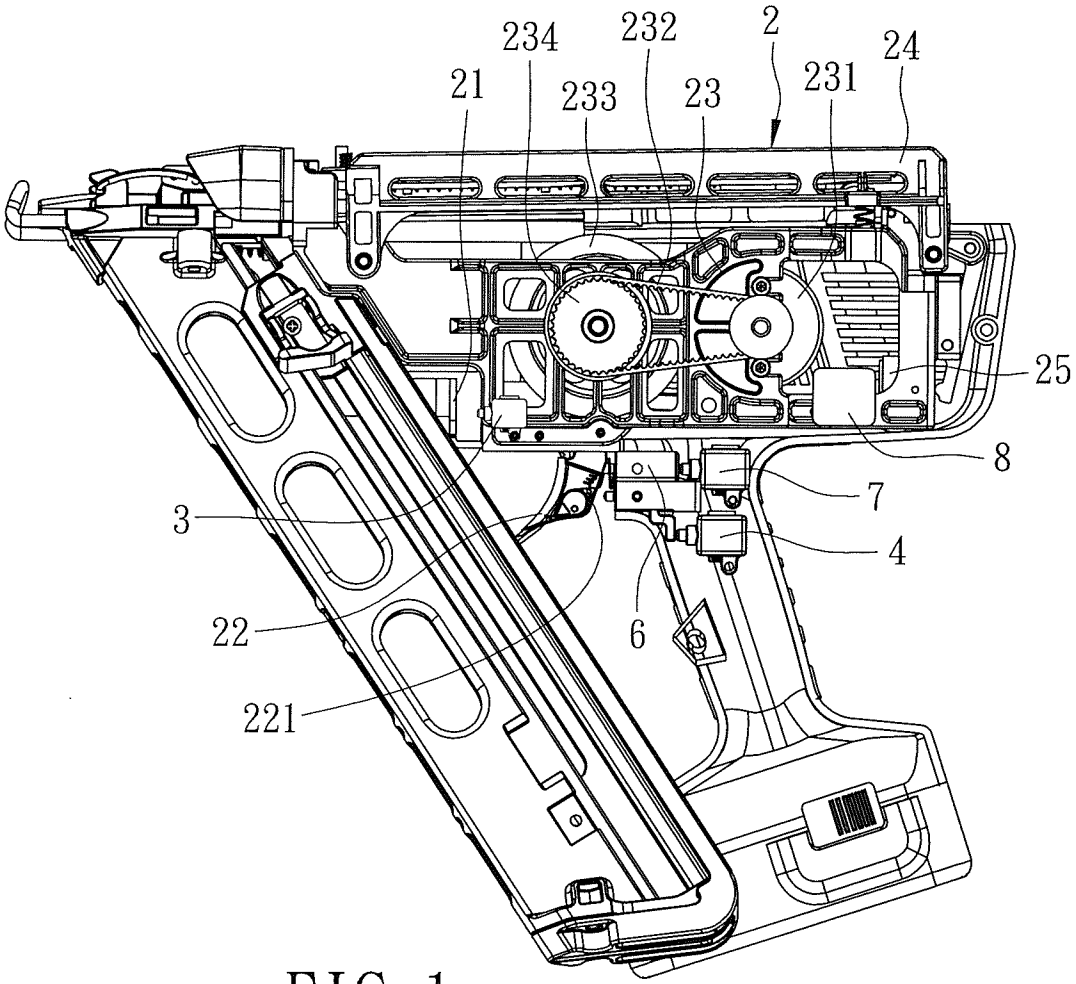
FIG. 1 is a fragmentary schematic sectional view showing an electric nail gun embodied with the preferred embodiment of a control mechanism according to the present invention.
Figure 2:
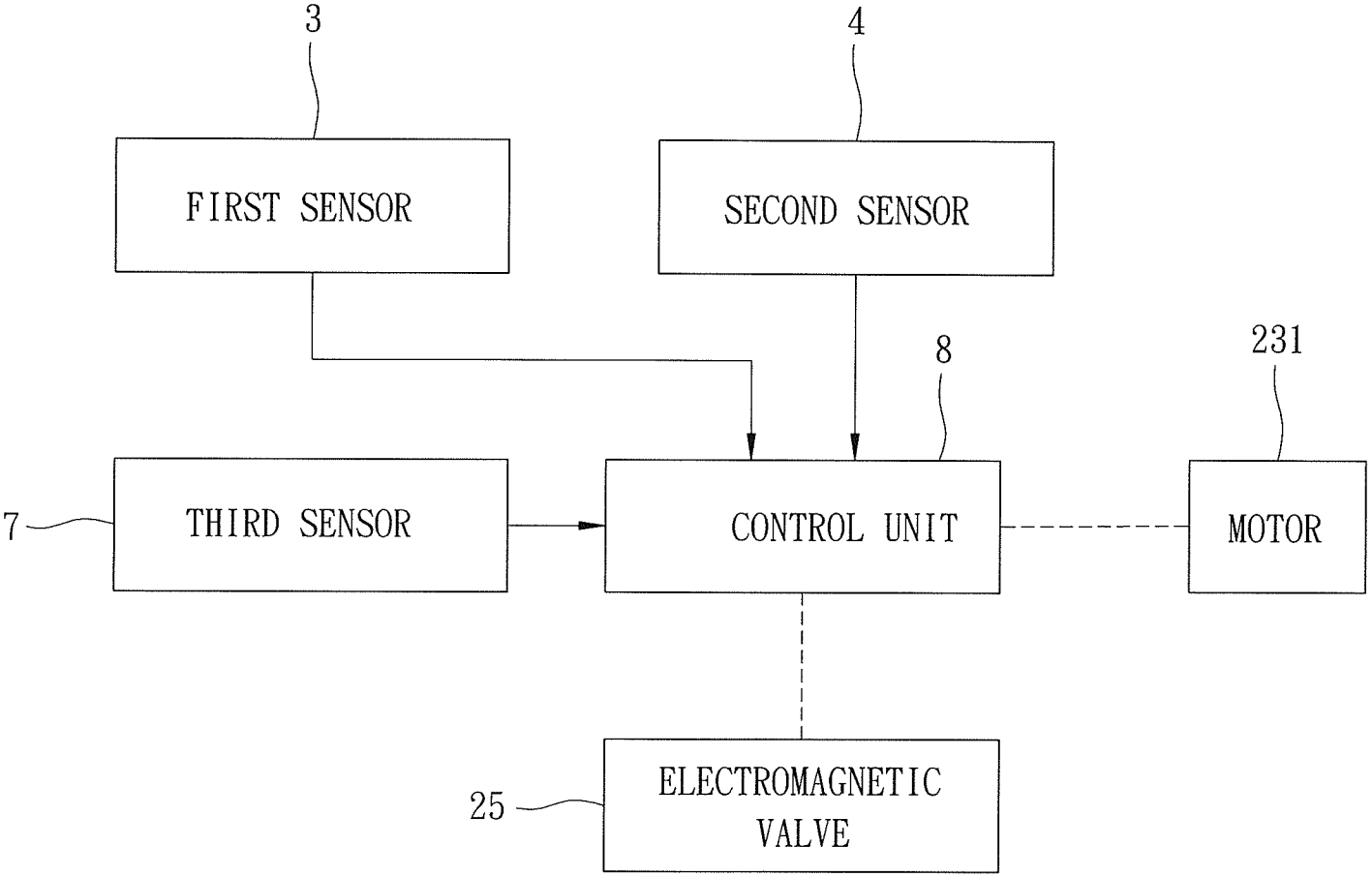
FIG. 2 is a schematic electrical circuit block diagram illustrating the preferred embodiment.

Referring to FIGS. 1 and 2, the preferred embodiment of a control mechanism according to the present invention is shown to be adapted for use with an electric nail gun 2. The electric nail gun 2 includes a safety member 21 movable between a normal position (see FIG. 3) and a pushed position (see FIG. 4), a trigger member 22 mounted pivotally on a supporting bracket and having a receiving groove 221, an impact unit 24, a flywheel 233 disposed pivotally in the supporting bracket, an electromagnet valve 25 for driving, when energized, the impact unit 24 to move toward the flywheel 233, and a driving module 23 for driving movement of the impact unit 24 at a high speed for performing the nail-striking operation. The driving module 23 includes a motor 231 having a drive shaft, a transmitting gear 234 coaxially rotatable with the flywheel 233, and a V-belt 232 trained over the drive shaft of the motor 231 and the transmitting gear 234 such that the flywheel 233 can be driven by the motor 231 to rotate at a high speed. Since the impact unit 24 is moved adjacent to the flywheel 233 due to driving of the electromagnetic valve 25, the flywheel 233 transmits power to the impact unit 24 for performing the nail-striking operation.

The control mechanism includes a first sensor 3, a second sensor 4, an actuating piece 5, a third sensor 7, and a control unit 8.

The first sensor 3 is adapted to be mounted in a gun body and is disposed adjacent to the safety member 21, and is operable to generate a first sensing signal in response to movement of the safety member 21 from the normal position to the pushed position. In this embodiment, the first sensor 3 is a touch switch, which is activated to generate the first sensing signal upon pressing of the safety member 21 (see FIG. 4) when the safety member 21 moves from the normal position to the pushed position.

Figure 5:
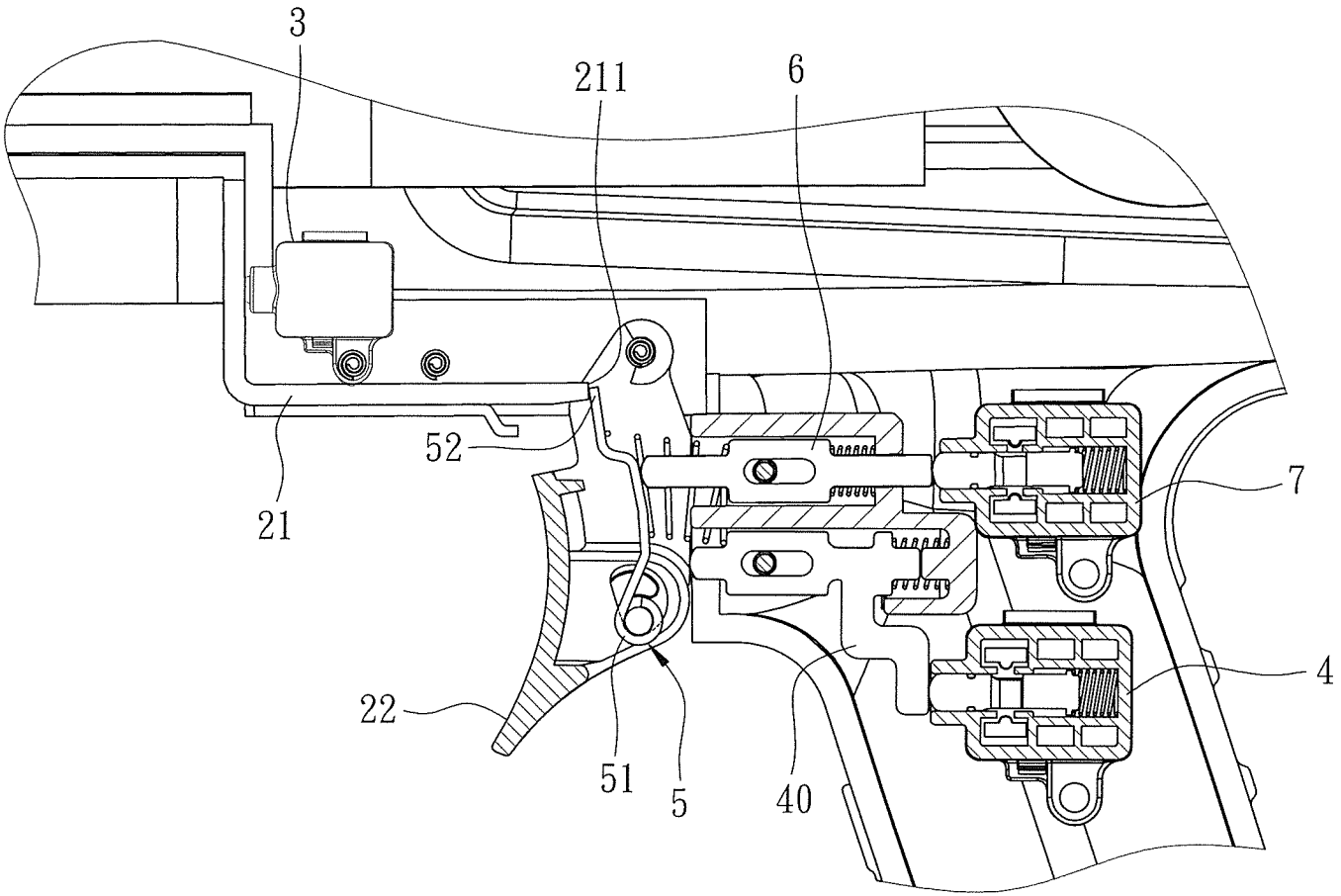
FIG. 5 is a fragmentary schematic sectional view illustrating the preferred embodiment when a third sensor is activated by the actuating piece in response to operation of a trigger member of the electric nail gun.

The second sensor 4 is adapted to be mounted in the supporting bracket, and is operable to generate a second sensing signal in response to operation of the trigger member 22. In this embodiment, the second sensor 4 is a touch switch. In addition, a first spring-loaded driven piece 40 is mounted movably in the supporting bracket, and is disposed between the trigger member 22 and the second sensor 4. As such, when the trigger member 22 is operated to rotate relative to the gun body, the second sensor 4 is activated to generate the second sensing signal through movement of the first spring-loaded driven piece 40 driven by the trigger member 22, as shown in FIG. 5.

Figure 3:
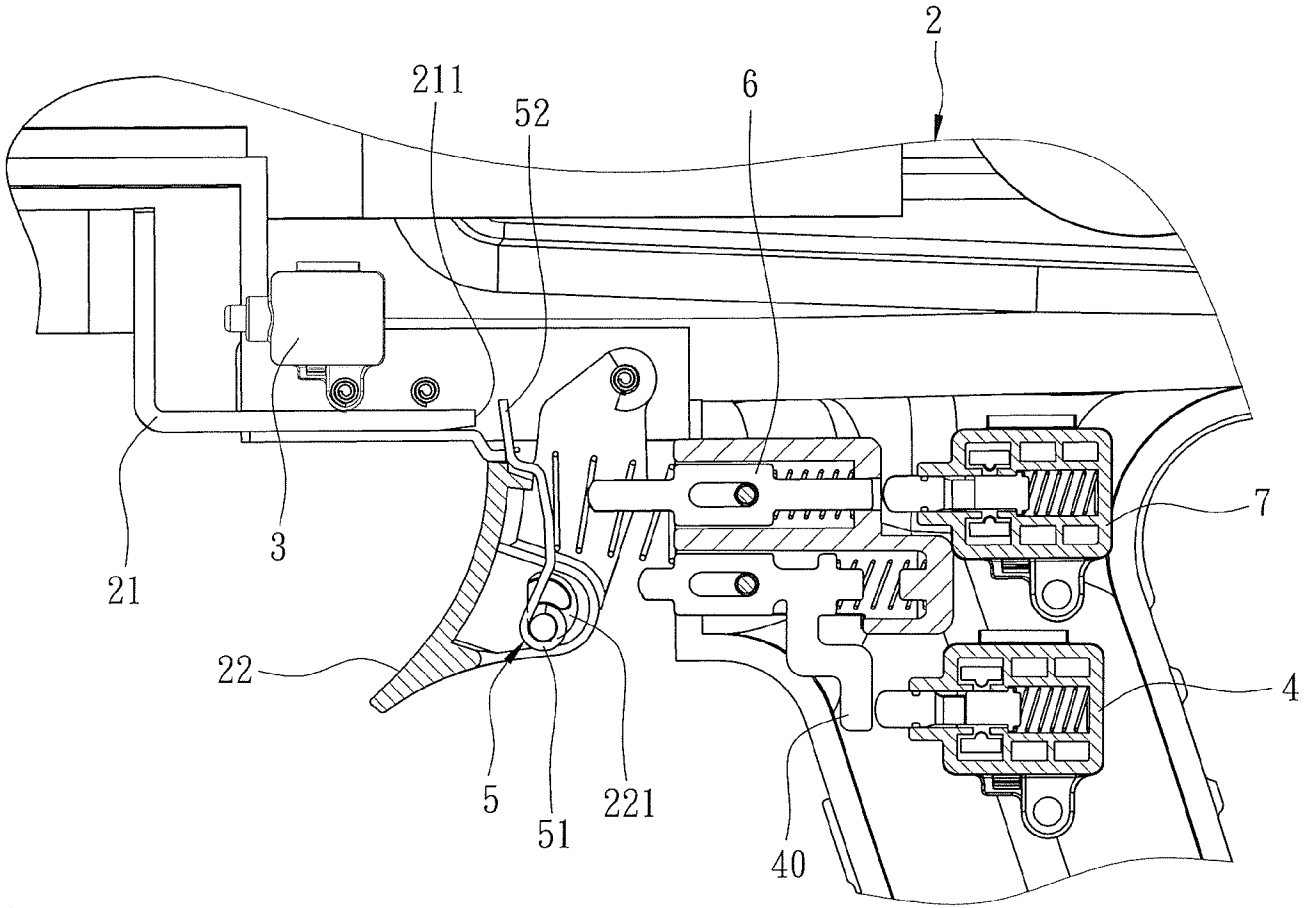
FIG. 3 is a fragmentary schematic sectional view illustrating the preferred embodiment when an actuating piece is in a single shot position.
Figure 4:
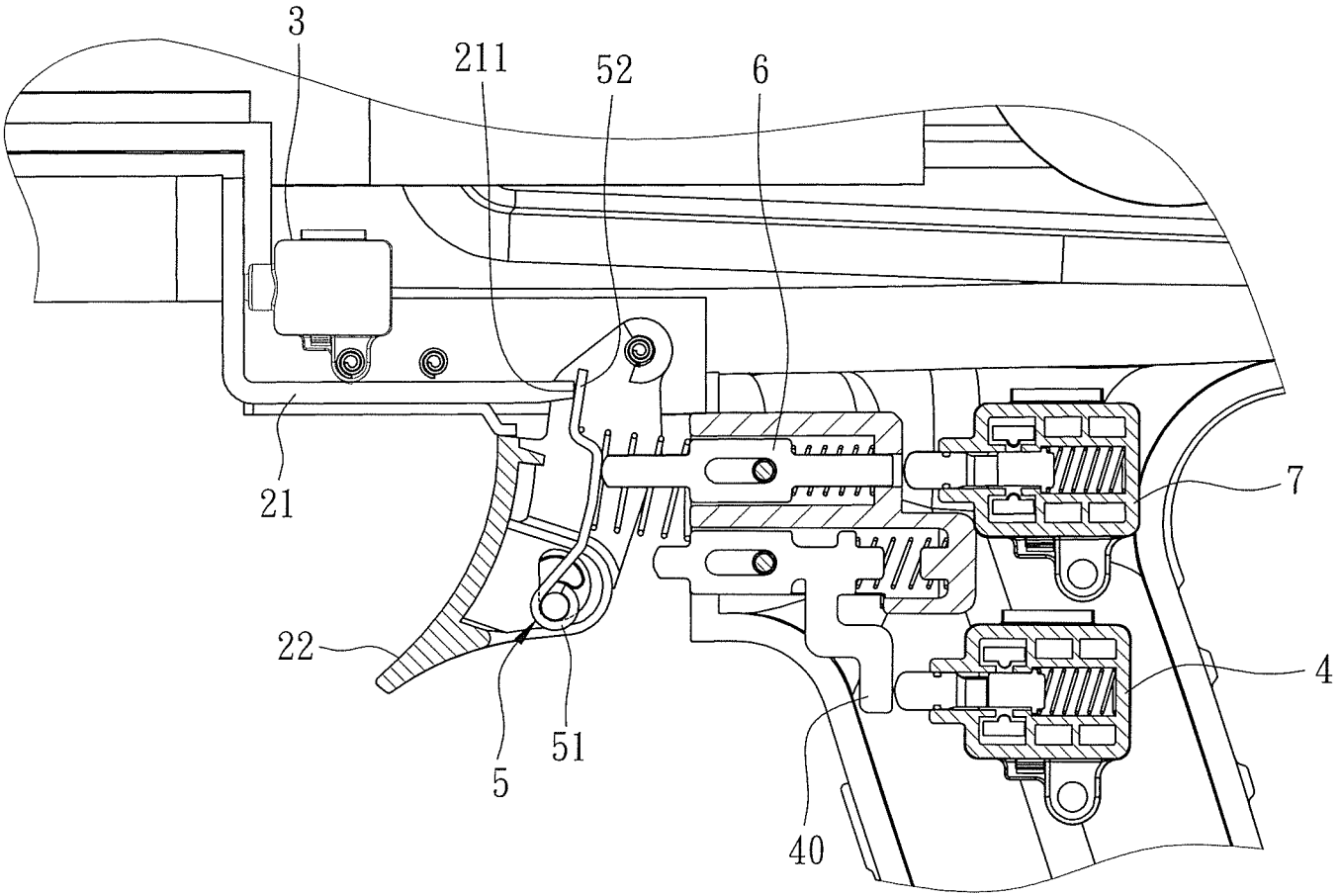
FIG. 4 is a fragmentary schematic sectional view illustrating the preferred embodiment when a first sensor is activated by a safety member of the electric nail gun.
Figure 7:
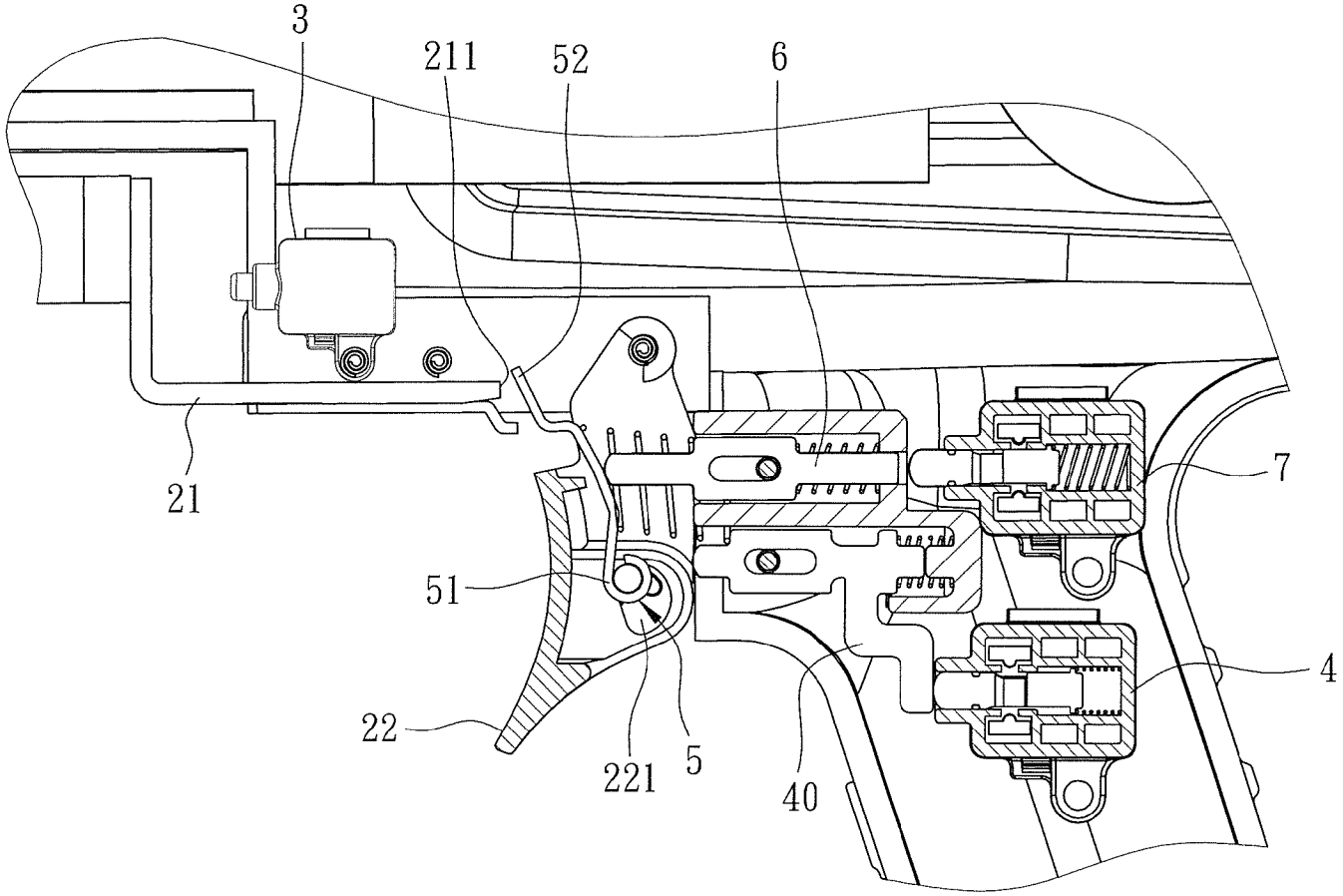
FIG. 7 is a fragmentary schematic sectional view illustrating the preferred embodiment when the actuating piece is in a successive shooting position.
Figure 8:
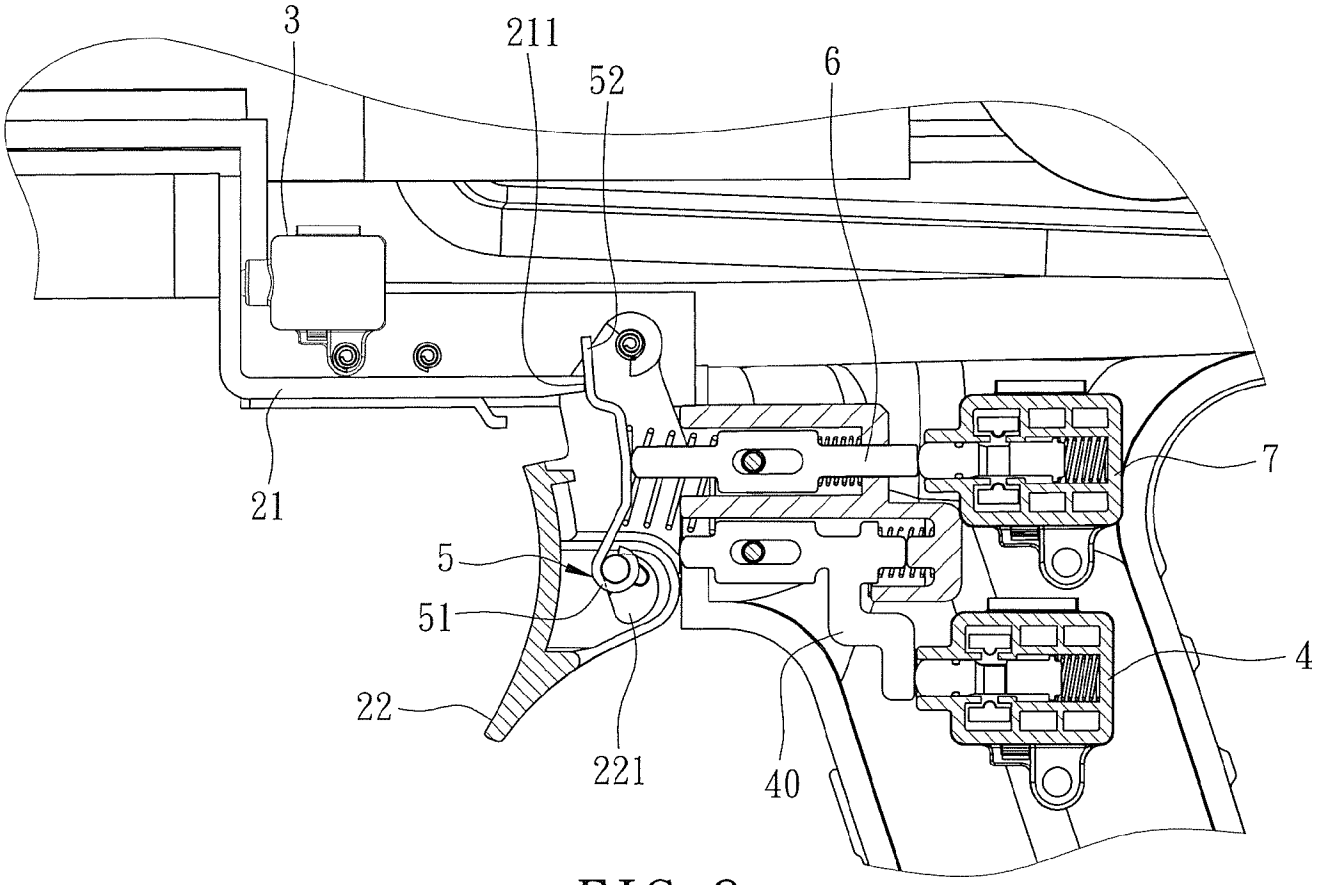
FIG. 8 is a fragmentary schematic sectional view illustrating the preferred embodiment when the third sensor is activated by the actuating piece in response to operation of the trigger member of the electric nail

The actuating piece 5 is adapted to be mounted movably in the trigger member 22 such that the actuating piece 5 is adjusted selectively to one of a lower single shot position (see FIG. 3) and a higher successive shooting position (see FIG. 7). The actuating piece 5 is rotatable relative to the trigger member 22 when in any one of the single shot position and the successive shooting position. In this embodiment, the actuating piece 5 has a pivot end portion 51 received in the receiving groove 221 in the trigger member 22, and a free end portion 52 opposite to the pivot end portion 51. When the safety member 21 is in the normal position, the free end portion 52 of the actuating piece 5 is spaced apart from an abutment end 211 of the safety member 21, as shown in FIGS. 3 and 7. When the safety member 21 moves from the normal position toward the pushed position, the abutment end 211 of the safety member 21 abuts against the free end portion 52 of the actuating piece 5, and drives the actuating piece 5 to rotate relative to the trigger member 22, as shown in FIGS. 4 and 8. It is noted that, since the actuating piece 5 is raised when moving from the single shot position to the successive shooting position, the free end portion 52 of the actuating piece 5 has a part extending out of the abutment end 211 when the safety member 21 is in the pushed position, as shown in FIG. 8.

The third sensor 7 is adapted to be mounted in the supporting bracket, and is operable to generate a third sensing signal in response to rotation of the actuating piece 5. In this embodiment, the third sensor 7 is a touch switch, in addition, a second spring-loaded driven piece 6 is mounted movably in the supporting bracket, and is disposed between the actuating piece 5 and the third sensor 7. As such, when the safety member 21 moves from the normal position to the pushed position so as to drive rotation of the actuating piece 5 relative to the trigger member 22, the third sensor 7 is activated to generate the third sensing signal through movement of the second spring-loaded driven piece 6 driven by rotation of the trigger member 22, as shown in FIG. 8.

The control unit 8 is connected electrically to the first, second and third sensors 3, 4, 7, and is adapted to be connected electrically to the motor 231 of the driving module 23 and the electromagnetic valve 25. The control unit 8 activates the motor 231 of the driving module 23 upon receipt of one of the first and second sensing signals from the first and second sensors 3, 4, and energizes the electromagnetic valve 25 upon receipt of the third sensing signal from the third sensor 7. As such, when the motor 231 is activated by the control unit 8, the motor 231 drives the flywheel 233 to rotate in a high speed. When the electromagnetic valve 25 is energized by the control unit 8, the electromagnetic valve 25 drives the impact unit 24 to move toward the flywheel 233.

In use, the electric nail gun 2 can easily operate in one of a single shot mode and a successive shooting mode using control of the control mechanism.

Figure 9:
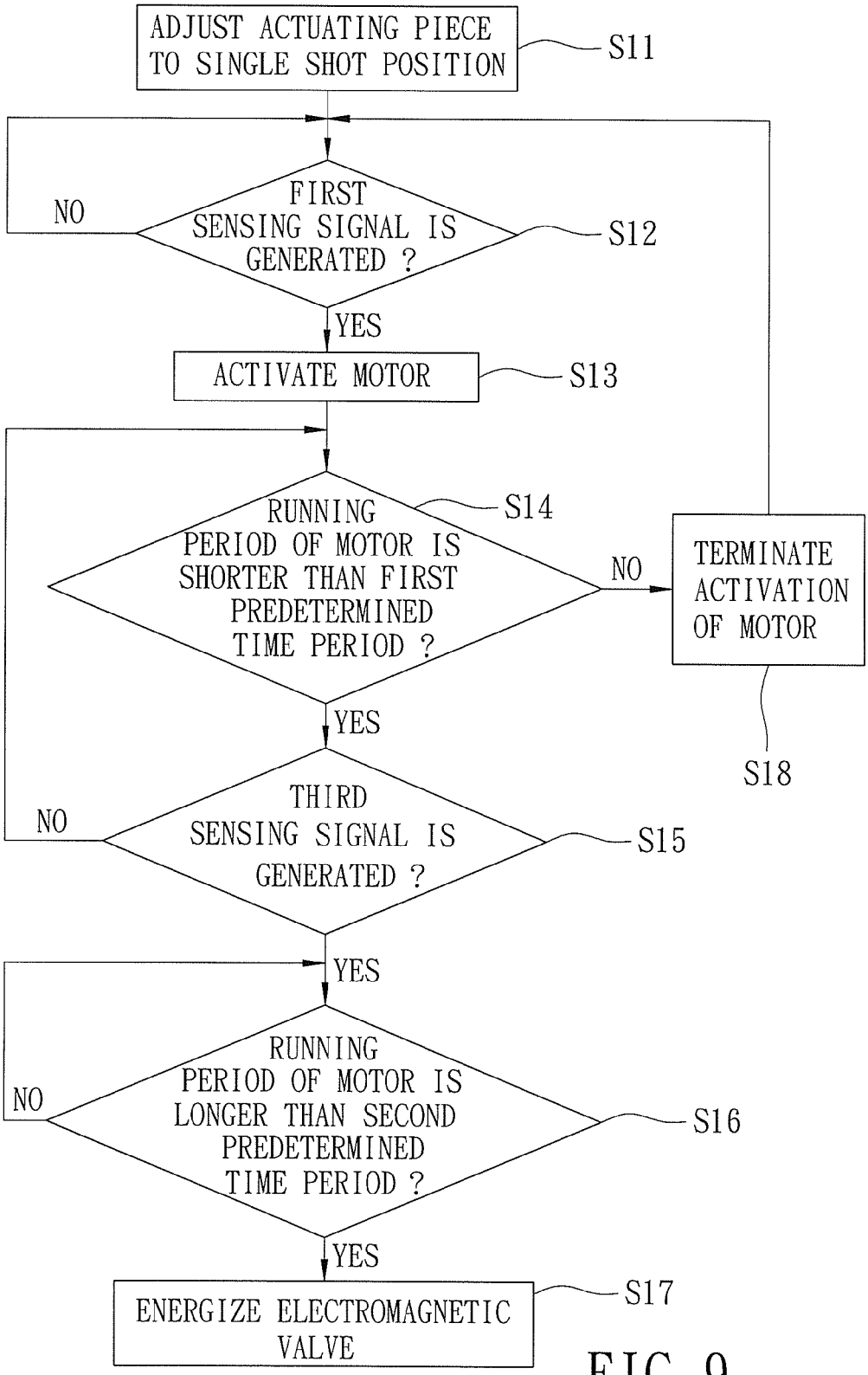
FIG. 9 is a flow chart showing a control procedure performed by the preferred embodiment when the electric nail gun is operated in a single shot mode.

FIG. 9 is a flow chart showing a control procedure performed by the control mechanism when the electric nail gun 2 is operated in the single shot mode.

In step S11, the actuating piece 5 is adjusted to the single shot position.

In step S12, it is determined whether the first sensing signal is generated by the first sensor 3 in response to movement of the safety member 21 from the normal position to the pushed position. If the result is affirmative, the flow goes to step S13. Otherwise, the flow goes back to step S12.

In step S13, the control unit 8 activates the motor 231 upon receipt of the first sensing signal from the first sensor 3.

In step S14, the control unit 8 determines whether a running period of the motor 231 is shorter than a first predetermined time period, such as a period of 3 seconds. If the result is affirmative, the flow goes to step S15. Otherwise, the flow proceeds to step S18.

In step S15, it is determined whether the third sensing signal is generated by the third sensor 7 in response to rotation of the actuating piece 5 driven by operation of the trigger member 22. If the result is affirmative, the flow goes to step S16. In this case, due to operation of the trigger member 22, the second sensor 4 generates the second sensing signal. Otherwise, the flow goes back to step S14.

In step S16, the control unit 8 determines whether the running period of the motor 231 is longer than a second predetermined time period, such as a period of 0.1 second. If the result is affirmative, the flow goes to step S17. Otherwise, the flow goes back to step S16.

Figure 6:
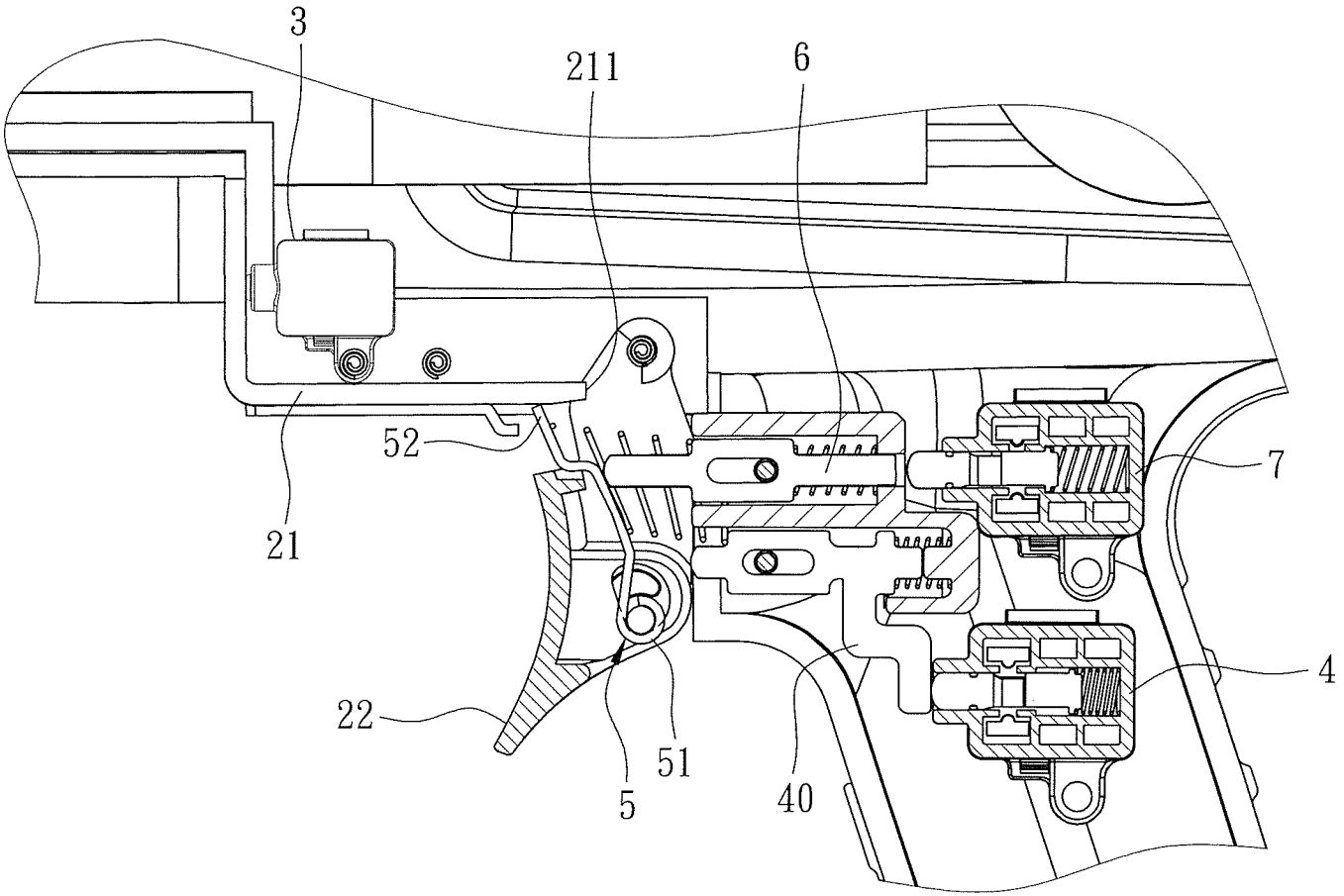
FIG. 6 is a fragmentary schematic sectional view illustrating the preferred embodiment when the actuating piece slides away from an abutment end of the safety member.

In step S17, the control unit 8 energizes the electromagnetic valve 25. Thus, the electromagnetic valve 25 drives the impact unit 24 to move toward the flywheel 233 such that the flywheel 233 transmits power from the driving module 23 to the impact unit 24, thereby performing the nail-striking operation. It is noted that, in the single shot mode, the free end portion 52 of the actuating piece 5 easily slides away from the abutment end 211 of the safety member 21 due to a recoiling force generated instantaneously upon nail-striking, as shown in FIG. 6. Since the abutment end 211 of the safety member 21 cannot abut against the free end portion 52 of the actuating piece 5, the third sensor 7 cannot be activated continuously due to movement of the second driven piece 6 away from the third sensor 7.

In step S18, when the control unit 8 determines in step S14 that the running period of the motor 231 is not shorter than the first predetermined time period, the control unit 8 terminates activation of the motor 231, thereby minimizing the idling period of the motor 231.

Figure 10:
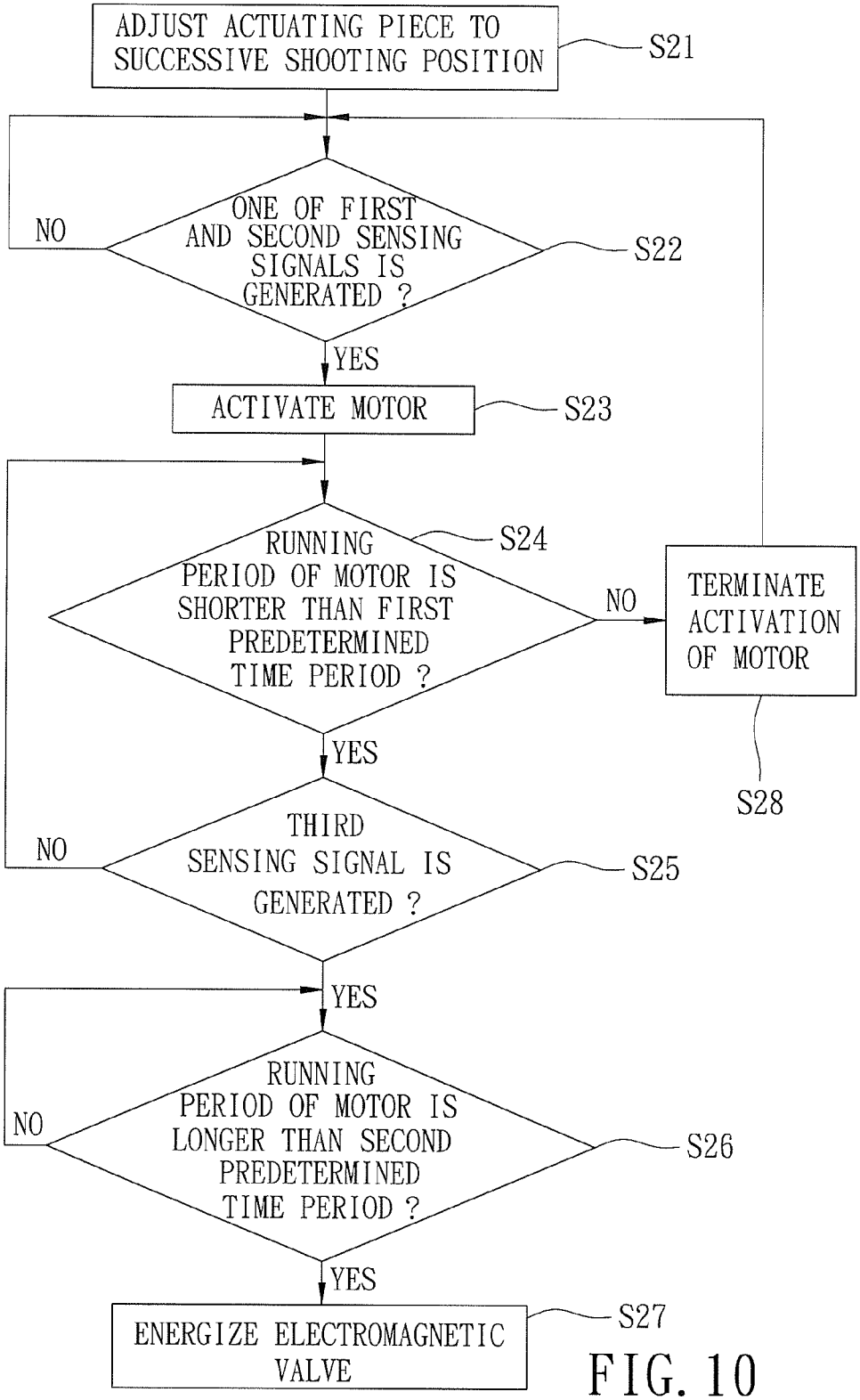
FIG. 10 is a flow chart showing a control procedure performed by the preferred embodiment when the electric nail gun is operated in a successive shooting mode.

FIG. 10 is a flow chart showing a control procedure performed by the control mechanism when the electric nail gun 2 is operated in a successive shooting mode.

In step S21, the actuating piece 5 is adjusted to the successive shooting position.

In step S22, it is determined whether one of the first and second sensing signals is generated by a corresponding one of the first and second sensors 3, 4 in response to a corresponding one of movement of the safety member 21 and operation of the trigger member 22. If the result is affirmative, the flow goes to step S23. Otherwise, the flow goes back to step S22.

In step S23, the control unit 8 activates the motor 231 upon receipt of said one of the first and second sensing signals from the corresponding one of the first and second sensors 3, 4.

Similar to step S14, in step S24, the control unit 8 determines whether a running period of the motor 231 is shorter than the first predetermined time period. If the result is affirmative, the flow goes to step S25. Otherwise, the flow proceeds to step S28.

Similar to step S15, in step S25, it is determined whether the third sensing signal is generated by the third sensor 7 in response to rotation of the actuating piece 5 driven by the other one of movement of the safety member 21 and operation of the trigger member 22. If the result is affirmative, the flow goes to step S26. In this case, due to the other one of movement of the safety member 21 and operation of the trigger member 22, the other one of the first and second sensing signals is generated by the other one of the first and second sensors 3, 4. Otherwise, the flow goes back to step S24.

Similar to step S16, in step S26, the control unit 8 determines whether the running period of the motor 231 is longer than the second predetermined time period. If the result is affirmative, the flow goes to step S27. Otherwise, the flow goes back to step S26.

Similar to step S17, in step S27, the control unit 8 energizes the electromagnetic valve 25. Thus, the electromagnetic valve 25 drives the impact unit 24 to move toward the flywheel 233 such that the flywheel 233 transmits power from the driving module 23 to the impact unit 24, thereby performing the nail-striking operation. During the successive shooting mode, due to the part of the free end portion 52 of the actuating piece 5, the free end portion 52 of the actuating piece 5 does not slide away from the abutment end 211 of the safety member 21 even if a recoiling force is generated instantaneously upon nail-striking. As a result, next nail-striking operation can be conducted through re-operation of any one of the safety member 21 and the trigger member 22.

Similar to step S18, in step S28, when the control unit 8 determines in step S24 that the running period of the motor 231 is not shorter than the first predetermined time period, the control unit 8 terminates activation of the motor 231, thereby minimizing the idling period of the motor 231.

In sum, by adjusting the actuating piece 5 to a desired one of the single shot position and the successive shooting position, the control unit 8 can easily control the electric nail gun 2 to operate in a desired one of the single shot mode and successive shooting mode based on the first, second and third sensing signals from the first, second and third sensors 3, 4, 7 through operation of the safety member 21 and the trigger member 22 without a complicated circuit, thereby avoiding the external interference encountered in the prior art.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A control mechanism for an electric nail gun, the electric nail gun including a tool body, a safety member movable between a normal position and a pushed position, a trigger member pivotally movable with respect to the tool body, an impact unit for nail-striking, a driving module for driving movement of the impact unit to perform a nail-striking operation, and an electromagnetic valve for driving the impact unit to move toward the driving module such that the impact unit is driven by the driving module to perform the nail-striking operation, said control mechanism comprising:

a first sensor adapted to be disposed adjacent to the safety member and operable to generate a first sensing signal in response to movement of the safety member from the normal position to the pushed position;

a second sensor operable to generate a second sensing signal in response to operation of the trigger member;

an actuating piece adapted to be mounted movably in the trigger member such that said actuating piece is adjusted selectively to one of a single shot position and a successive shooting position, and rotatable relative to the trigger member when in any one of the single shot position and the successive shooting position;

a third sensor operable to generate a third sensing signal in response to rotation of the actuating piece;

and a control unit adapted to be connected electrically to the driving module and the electromagnetic valve, and connected electrically to said first, second and third sensors;

wherein said control unit activates the driving module upon receipt of one of the first and second sensing signals from said first and second sensors, and energizes the electromagnetic valve upon receipt of the third sensing signal from said third sensor.

2. The control mechanism as claimed in claim 1, wherein said control mechanism is configured to control the electric nail gun to operate in a single shot mode, where said actuating piece is disposed in the single shot position, and where said control unit first receives sensing signal from said first sensor in response to movement of the safety member from the normal position to the pushed position, and subsequently receives the third sensing signal from said third sensor in response to rotation of said actuating piece driven by operation of the trigger member.

3. The control mechanism as claimed in claim 1, wherein said control mechanism is configured to control the electric nail gun to operate in a successive shooting mode, where said actuating piece is disposed in the successive shooting position, and where said control unit first receives one of the first and second sensing signals from said first and second sensors in response to a corresponding one of movement of the safety member and operation of the trigger member, and subsequently receives the third sensing signal from said third sensor in response to rotation of said actuating pieces driven by the other one of movement of the safety member and operation of the trigger member.

4. The control mechanism of claim 2, wherein the actuating piece is adapted to slide away from an abutment end of the safety member and away from contact with the third sensor upon a first operation of the electric nail gun in the single shot mode.

5. A control mechanism for an electric nail gun, the electric nail gun including a tool body, a safety member movable between a normal position and a pushed position, a trigger member pivotally movable with respect to the tool body, an impact unit for nail-striking, a driving module for driving movement of the impact unit to perform a nail-striking operation, and an electromagnetic valve for driving the impact unit to move toward the driving module such that the impact unit is driven by the driving module to perform the nail-striking operation, said control mechanism comprising:

a first sensor adapted to be disposed adjacent to the safety member and operable to generate a first sensing signal in response to movement of the safety member from the normal position to the pushed position;

a second sensor operable to generate a second sensing signal in response to operation of the trigger member;

an actuating piece adapted to be mounted movably in the trigger member such that said actuating piece is adjusted selectively to one of a single shot position and a successive shooting position, and rotatable relative to the trigger member when in any one of the single shot position and the successive shooting position;

a third sensor operable to generate a third sensing signal in response to rotation of the actuating piece;

and a control unit adapted to be connected electrically to the driving module and the electromagnetic valve, and connected electrically to said first, second and third sensors;

wherein said control unit activates the driving module upon receipt of either one of the first and second sensing signals from said first and second sensors, and energizes the electromagnetic valve upon receipt of the third sensing signal from said third sensor.

6. The control mechanism as claimed in claim 5, wherein said control mechanism is configured to control the electric nail gun to operate in a single shot mode, where said actuating piece is disposed in the single shot position, and where said control unit first receives sensing signal from said first sensor in response to movement of the safety member from the normal position to the pushed position, and subsequently receives the third sensing signal from said third sensor in response to rotation of said actuating piece driven by operation of the trigger member.

7. The control mechanism as claimed in claim 5, wherein said control mechanism is configured to control the electric nail gun to operate in a successive shooting mode, where said actuating piece is disposed in the successive shooting position, and where said control unit first receives one of the first and second sensing signals from said first and second sensors in response to a corresponding one of movement of the safety member and operation of the trigger member, and subsequently receives the third sensing signal from said third sensor in response to rotation of said actuating pieces driven by the other one of movement of the safety member and operation of the trigger member.

8. The control mechanism of claim 6, wherein the actuating piece is adapted to slide away from an abutment end of the safety member and away from contact with the third sensor upon a first operation of the electric nail gun in the single shot mode.

* * * * *